US006949723B2

(12) United States Patent
Staebler et al.

(10) Patent No.: US 6,949,723 B2
(45) Date of Patent: Sep. 27, 2005

(54) COOKTOP CONTROL

(75) Inventors: Manfred W. Staebler, New Bern, NC (US); Thomas L. Tino, Irvine, CA (US); Nils Platt, New Bern, NC (US)

(73) Assignee: BSH Home Appliances Corporation, Huntington Beach, CA (US)

( * ) Notice: Subject to any disclaimer, the term of this patent is extended or adjusted under 35 U.S.C. 154(b) by 0 days.

(21) Appl. No.: 10/619,121

(22) Filed: Jul. 14, 2003

(65) Prior Publication Data

US 2004/0007566 A1 Jan. 15, 2004

Related U.S. Application Data

(63) Continuation of application No. 09/884,370, filed on Jun. 19, 2001, now abandoned.

(51) Int. Cl.[7] ..... H05B 3/68
(52) U.S. Cl. ..... 219/445.1; 219/448.11
(58) Field of Search ..... 219/445.1, 446.1, 219/447.1, 448.11, 448.13, 518; 126/90 A, 92 A, 217

(56) References Cited

U.S. PATENT DOCUMENTS 3,974,472 A * 8/1976 Gould, Jr. ..... 345/211
4,121,204 A * 10/1978 Welch et al. ..... 345/174
4,446,455 A * 5/1984 Nashawaty ..... 340/568.1
4,454,501 A * 6/1984 Butts ..... 341/22
4,527,049 A * 7/1985 Thomas et al. ..... 219/446.1
5,155,338 A * 10/1992 Hoffmann ..... 219/445.1
5,294,779 A * 3/1994 Miquelot ..... 219/447.1
5,357,079 A * 10/1994 Henry et al. ..... 219/445.1
6,097,016 A 8/2000 Hirata et al.
6,198,080 B1 * 3/2001 Rice et al. ..... 219/506

* cited by examiner

*Primary Examiner*—Sang Paik
(74) *Attorney, Agent, or Firm*—John T. Winburn; Russell W. Warnock; Craig J. Loest

(57) ABSTRACT

A cooktop with a ceramic glass panel has a panel portion with a first indicia set for selection of a burner and a second indicia set for selection of a power level to the selected burner. Each set of indicia is associated with switches for input to a control circuit in response to manipulation by a user. In addition, each indicia set includes a display interactive with the manipulation of the other indicia set. Preferably, the control circuit includes a processor for responding only to a sequential manipulation of an indicia from the first set indicia set and a sequential manipulation of an indicia from the second set within a predetermined time period.

12 Claims, 2 Drawing Sheets

COOKTOP CONTROL

CROSS-REFERENCE TO RELATED APPLICATIONS

This application is a continuation of copending application U.S. Ser. No. 09/884,370 filed Jun. 19, 2001, now abandoned which is incorporated herein by reference.

BACKGROUND OF THE INVENTION

1. Field of the Invention

The present invention relates to a cooktop with a glass ceramic panel covering burners that is provided with burner selector indicia and power selection indicia associated with switches that provide input to a processor controlling actuating and deactuating of the burners.

2. Background Art

Cooktops with ceramic glass panels have been developed in order to provide a smooth, easily cleaned surface that prevents spills from reaching the burners or the interior of the appliance. Of course, the controls must be readily accessible to a cooktop user. The use of traditional controls such as knobs, dials and the like can increase difficulty of cleaning the appliance and the difficulty of preventing spills from reaching the interior of the appliance.

A previously known improvement to operate the electronic control of the cooktop has been to use remote handheld units having switches such as numeric keypads and the like for selecting power levels of a burner and selection of the burners to be actuated. However, such devices require transmitters and receivers, a particular alignment between the handheld unit and the embedded controller, and power to operate the remote unit as well as the embedded control. As a result, the units are complicated and expensive, and the keypads of the controller may be subject to the same difficulty of cleaning as previously known appliance mounted controls, particularly when the handheld unit is rested on the appliance.

Another known cooking apparatus such as the microwave oven shown in U.S. Pat. No. 6,097,016 provides screens which can be bookmarked and retrieved as desired. In addition, a switching display can include overlaid film and layers that together form switch members for actuating displays in response to images on the screen. Nevertheless, power selection is through a typical numerical keyboard separate from the heating source selector indicia, and the selector indicia and the power selection indicia do not include interactive displays for the other selector.

Other cooktops with glass or glass ceramic cooking surfaces and multiple cooking zones may include recesses in the glass ceramic panel. The recesses form operational zones, preferably formed by glass or glass ceramic parts embedded in the cooking surface by means of a temperature stable sealing connection such as a silicone layer. The cooking surface exhibits rigid operational zones for display, and flexible mount zones for weighing and operating switch elements.

In another glass ceramic plate covering a heating element, the control element includes relief in the form of a bump or recess in the top surface that provides tactile identification of control elements. Preferably, a plurality of relief elements correspond to the power levels and the different relief elements include different tactile characteristics to represent the different power levels. However, inadvertent actuation with manipulation of one of the indicia may accidentally increase power levels or initiate burner actuation and result in unexpected consequences by the heating control.

BRIEF SUMMARY OF THE INVENTION

The present invention overcomes the above-mentioned disadvantages by providing a cooktop with a glass ceramic panel covering the heating elements and a control including a processor beneath the glass ceramic panel. The panel displays indicia including a first set of at least one indicia designating a burner selection, and a second set including at least one multiple level indicia for selecting a power level of a selected burner. The indicia are associated with switches that enable the control's processor to selectively actuate at least one burner in response to sequential manipulation of the first and second sets of indicia and deactivating a selectively actuated burner in response to manipulation of either one of the first and second sets of indicia.

In the preferred embodiment, the first set of indicia includes a display, which may be interactively effected by the second set of indicia. In particular, on first actuation of a burner designation in the first set of indicia, a display may illuminate a 0 to identify that a manipulation to select that burner has been provided. Upon subsequent actuation of an indicia at the power selector set, the display at both the first and second sets may illustrate a corresponding level of power for the selected burner. While the display at the power selector indicia may be terminated after a predetermined time delay, the selected burner maintains a display while the burner is activated. Nevertheless, activation of either an indicia at the first set or an indicia at the second set may reset the display at the first set to 0 so that inadvertent activations of one of the switches that does not unexpectedly increase the power level at which the selected burner is operated.

In the preferred embodiment, the power level indicia set may include multiple ranges of power levels applicable to each burner. For example, one or more of the burners may be actuated with a WARMING indicia at the second set associated with a switch for controlling the processor to generate a reduced duty cycle current, for example, two (2) seconds on, fifty (50) seconds off, to provide a warming function at one or more burners as they are selected. In addition, the cooktop control may include sensor cooking, whereby a sensor probe is associated with at least one of the burners. In the preferred embodiment, a pop-up, retractable probe with a temperature sensor may be connected to the controller so that the sensor may determine whether the utensil at the burner is being kept at the proper heating range. Preferable, a selectively visible indicia appears at the power selector indicia set when the probe has been actuated, and the indicia may provide an additional range of cooking power levels that my be delivered by the processor to the burner heating element.

BRIEF DESCRIPTION OF THE SEVERAL VIEWS OF THE DRAWING

The present invention will be more clearly understood by reference to the following detailed description of the invention, in which like reference characters refer to like parts throughout the views, and in which.

DETAILED DESCRIPTION OF INVENTION

Figure 1:
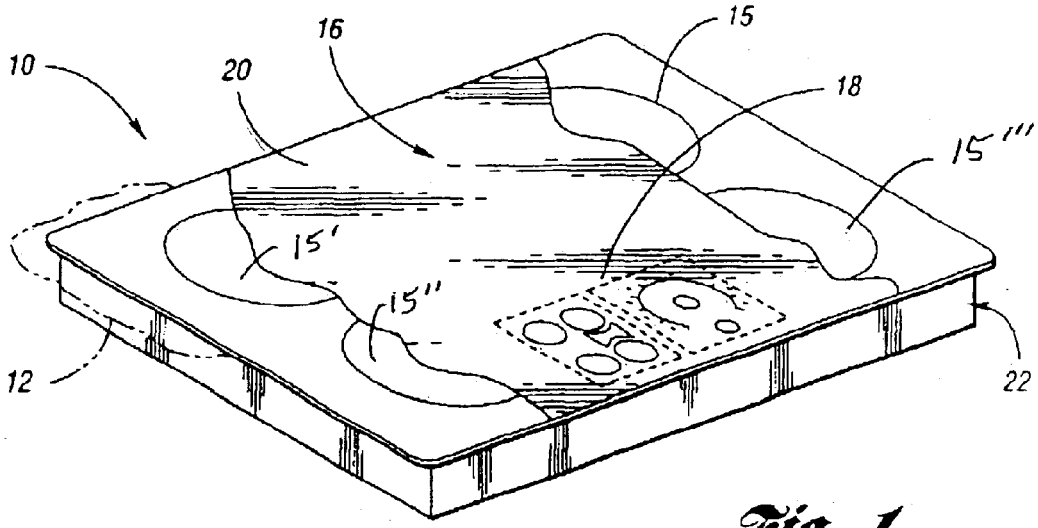
FIG. 1 is a perspective view of the glass ceramic cooktop with a control constructed in accordance with the present invention.

Referring first to FIG. 1, a cooktop 10 is shown for installation in a housing 12 that can be of any of type that supports a cooktop panel 16 at an appropriate height for a user to place cooking utensils and operate a control panel portion 18. The housing 12 may be a dedicated appliance housing, that may contain other cooking devices such as microwave ovens, convection heating ovens, jet impingement ovens and the like within the housing, or the housing may be a built-in kitchen counter with an opening in the countertop to receive the cooktop separately. In any event, the cooktop 10 includes the glass ceramic cooktop panel 16 that provides a smooth surface impermeable to liquids and the like that may be spilled on the cooktop. A rough-in box 22 preferably encloses the electronic controls, a plurality of burners 15, 15', 15" and 15'" including heating elements and the supports for those devices carried beneath the panel 16.

Figure 2:
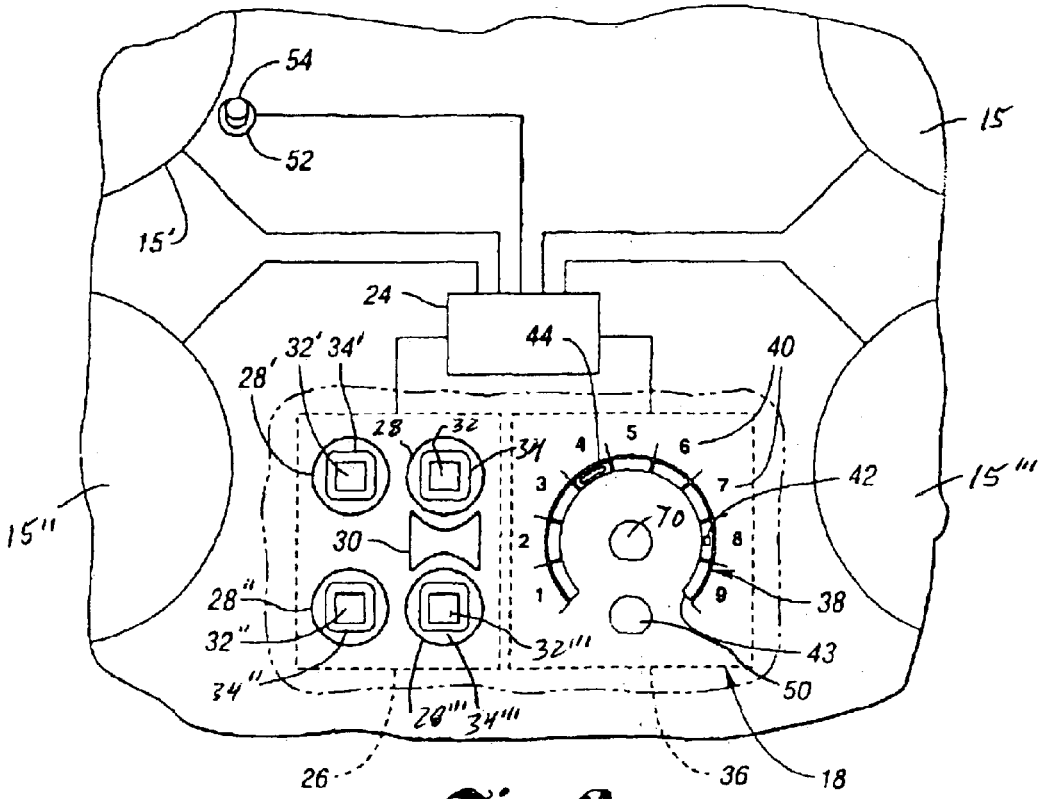
FIG. 2 is an enlarged plan view of a portion of the cooktop panel shown in FIG. 1 with additional schematic representations for the sake of clarity.

As schematically shown in FIG. 2, the control portion or area 18 including a computerized processor controls electrical power signals delivered to the plurality of burners 15, 15', 15" and 15'" in the cooktop 10 in response to a user's tactile manipulation of indicia visible on the panel surface at the control portion 18. The processor may be programmable to include various functions, interface with and respond to the wide variety of indicia that may be visible at the control area 18. In the preferred embodiment a first indicia set 26 includes a plurality of burner selector indicia 28, 28', 28", 28'" in the form of circles imprinted upon the cooktop panel 16. The manner of applying the indicia 28 may be different, for example, etching, decals, displays, illuminations or the like may be used to designate an indicia location. Of course, the number of indicia 28 may be changed depending upon the number of burners 15 to be operated at the control, but at least one of the burners 15 will operate in accordance with the method describing the operating in accordance with the present invention. In the preferred embodiment, the circle indicia 28, 28', 28" and 28'" are arranged in a pattern corresponding to the placement of the burners 15, 15', 15" and 15'" in the cooktop 10 for ease of reference by the user. A coupling indicia 30 demonstrates that the operation of a pair of the burners 15 and 15'" can be combined when a large pan covering the area over the burners is used on the cooktop.

A switch 32 is associated with each indicia 28 so that touching of the indicia 28 affects operation of the associated witch 32 as an input to the control processor circuit 24. The switches 32, 32', 32" and 32'" may be carried by circuit boards or the like carried under the cooktop panel 16. In the preferred embodiment, touch or proximity sensor switches avoid the need for mechanical tactile switches that must be physically moved below the ceramic glass panel 16.

In addition, the circuit arrangement beneath the panel supports a corresponding display member 34, 34', 34", 34'" for example a numerical LED arrangement, to specify a power level parameter that has been applied when the associated burner has been activated. A display 34 may be controlled for selective visibility at the indicia 28 when a selected burner 15 has been assigned a particular power level as discussed in greater detail below.

The control area 18 also includes a second set 36 of power level indicia. In the preferred embodiment, a segmented ring indicia 38 includes numerical indicia 40 identifying a variety of power levels around the indicia ring 38. In a manner similar to the indicia 28 of the burner selector set 26, the power selector set 36 is associated with switches 42 so that a manipulation such as touching of a segment 43 (one numbered) in indicia ring 38 induces an input to the control circuit 24. In addition, the power selection set 36 may also include display elements 34 associated with each segment 43 of the indicia ring 38 to provide a selectively visible indication that power selection has been enabled, for example, flashing illumination when the power level may be set for a selected burner 15. Moreover, the switches 42 associated with the second or power selection set 36 may be incremental switches, for example, an up arrow and a down arrow indicia (not illustrated) to vary the power level selected.

The operation of the control area 18 in accordance with the above description may be better understood by reference to the following detailed description of an example of operation. To operate the left rear burner 15' designated by indicia 28', the user may actuate a corresponding switch 32' by touching the left indicia 28'. On actuation of the switch 32' associated with that indicia, a display 34' may also be energized to designate a 0 to demonstrate that no power level has yet been selected for the burner 15'. Input delivered to the control circuit 24 generates a signal 44 input to the power level indicia set 36 to indicate that a power level should be set. Such a signal may also provide a visible indication, as may be provided by one or more of the display segments 43 being illuminated, for example, in a pulsing light display, to indicate that a power level must be set in order to activate the left rear burner 15'. Upon sequential manipulation of an indicia segment 43 on the ring 38 in the power level set 36 of indicia, the intermittent pulsing of the illuminated segments may be terminated.

The input of the switch 42 to the controller 24 also generates a response in the control circuit to change the display 34 to designate the selected power level, for example, an LED display of the number 5 (not illustrated), that corresponds with the ring segment 43 selected at the second set 36. If the left rear indicia 28' or the indicia ring 38 is again manipulated by a user, the control circuit 24 deactivates the left rear burner 15', resignals the display 34 to a base level indication such as 0, and may reintroduce the pulsed illumination at the display 44 at the indicia ring 38. The power level may be restored whenever a sequential manipulation of an indicia 28 and an indicia 38, from the first set 26 and second set 36, respectively, haven been performed within a predetermined time. Either or both displays 34 and 44 may be deactivated after a predetermined time when no power is being delivered to a selected burner 15.

An additional indicia such as the combined burner operation indicia 30 may be associated with a switch which signals the control circuit 24 to enable both the right rear and right front burners 15 and 15'" for operation, and illuminating the associated displays 34 and 34'" in unison at the same power level. Similarly, a timely sequential manipulation of the power level ring 38 will signal through its associated switch or switches 42 to provide the control circuit 24 with an indication of the power level of the signal to be sent to both the right rear and right front burners 15 and 15'". Correspondingly, the displays 34'" and 34, at the right front and right rear indicia 28'" and 28 will provide the same display corresponding to the selected segment 43 of the indicia ring 38.

In addition, additional indicia may be provided to the power level set 36 to represent multiple power levels available to the burners. For example, a WARM indicia 50 may be used to designate a switch whose manipulation enables the control circuit 24 to provide a low power level to the burner 15 selected at the first indicia set 26. For example, a low duty cycle current may be activated by the control circuit 24, when the sequential manipulation of the indicia 50 from the second indicia set 36 has been manipulated. For example, the signal may limit heating power in a predetermined interval, for example, two (2) seconds of power during a fifty (50) second time period, so that the burner 15 generates very low warming head at the burner.

Figure 3:
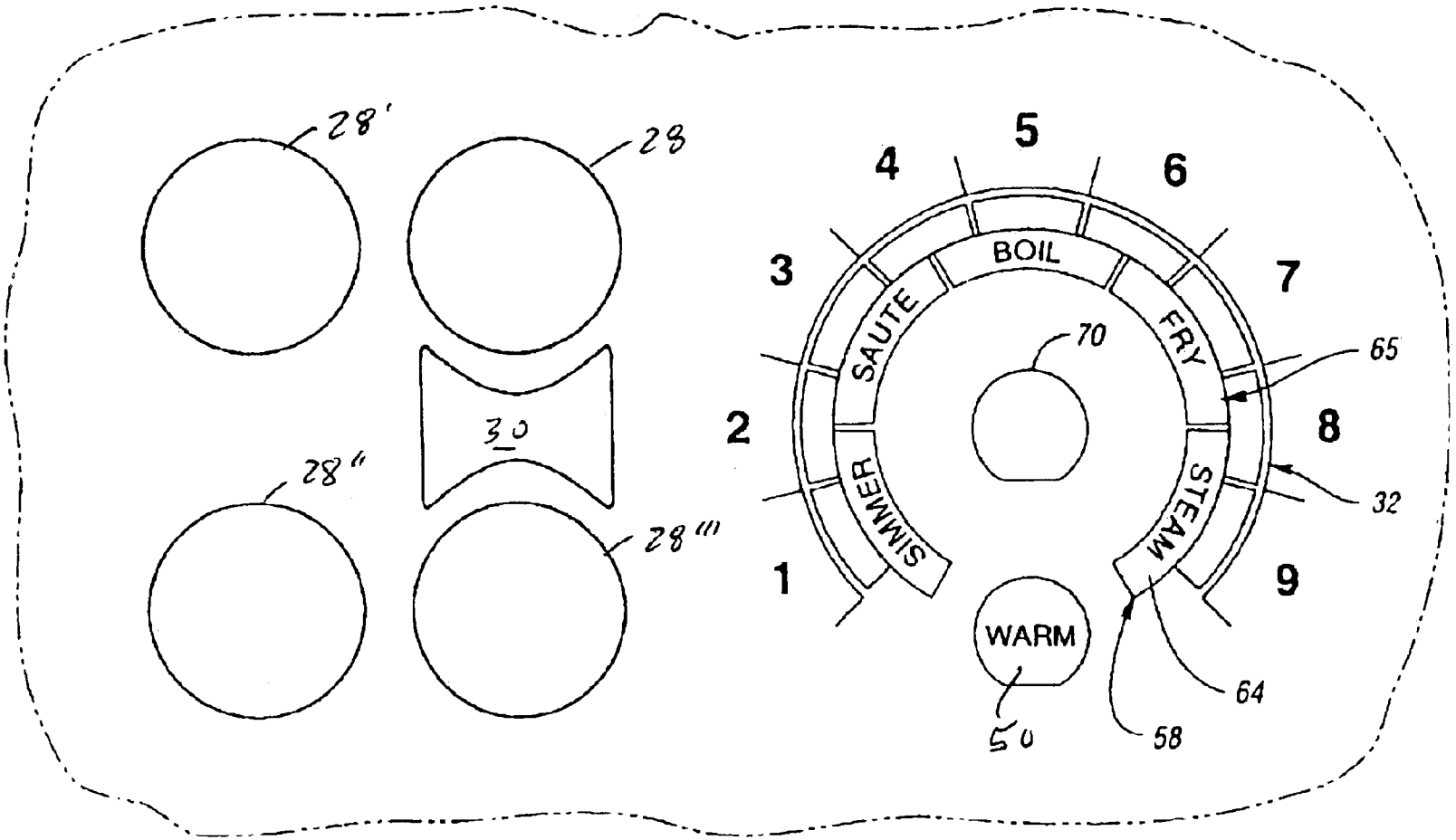
FIG. 3 is an enlarged view similar to FIG. 2 but showing the power level indicia visible in a second operating condition of the cooktop.

The indicia sets may also provide selectively visible indicia when other optional functions are programmed into the circuit control 24. For example, as shown in FIG. 2, a temperature sensor 52 may be provided near a burner on a retractable probe arm 54. When the probe arm 54 is extended, the sensor 52 is positioned to contact the utensil placed on the burner. The control circuit 24 may generate a selectively visible ring 58 in the second indicia set 26 as shown in FIG. 3. The selectively visible indicia ring 58 can include additional display segments 64 and associated switches 42 at each selectively visible segment 64 of the ring 58. Moreover, each of the segments 64 may be provided with additional indicia that demonstrate the heat range available for selection at the indicia. For example, the segments may be labeled with indicia designating SIMMER, SAUTE, BOIL, FRY and STEAM to identify the type of heating operation occurring at the burner. Nevertheless, the particular type of burner operations to be performed need not be limited to defined cooking operations. For example, a proximity sensor may be carried by the probe so that the presence of a pot at the burner may be indicated at indicia 70. Whenever the probe may be retracted into the cooktop housing, the selectively visible ring 58 may terminate so that the cooking power ranges associated with the indicia ring 38 can be used.

The control circuit 24 may be programmed for additional operations. For example, if a previously heated burner 15 has been turned off, a display 34 of that burner may be provided with a display 34 such as H to provide a visual indication that the burner may still be in a cooling state. The display 34 may be activated for a predetermined time based on typical cooling periods, or otherwise be responsive to a sensor located at each burner. In any event, a burner 15 may not be inadvertently turned on by actuation of a single indicia at one of the indicia sets 36 or 38, because a sequential operation of an indicia in the first set 36 followed by a timely, sequential manipulation at the second indicia set 36 will be required before the control circuit 24 delivers power to the burner 15. Moreover, actuation of one of the indicia in one of the sets subsequently suspends operation of the burner 15 until another power level selection has been made at the second indicia set.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A cooktop control for a cooktop including a glass ceramic panel and a plurality of burners forming a pattern under said panel, said control, comprising:

a first set of burner indicia visible on said cooktop panel in a first control area separated from said burners, each one of said indicia separately associated with one of said burners, said indicia formed in a pattern matching said burner pattern, each one of said separate burner indicia each including a display and a switch associated therewith;

a single second set of indicia visible on said cooktop panel in a second control area separated both from said burners and said first control area, said second set of indicia including a display and a first plurality of power level switches associated therewith, said single second set of indicia formed in a substantially circular arc or ring, said second set of indicia controlling the power level of each of said burner indicia;

an inner indicia ring including a third set of indicia, said inner indicia ring located adjacent said ring of said second set of indicia, said inner ring of indicia including a display and a second plurality of power level switches associated therewith; and a circuit controlling the specific one of said burners in response to activation of said associated first indicia and the power setting for said specific associated burner set in response to activation of one of said plurality of power lever switches.

2. The control according to claim 1, including said first set of indicia including a combined burner operating indicia including a display and a switch associated therewith associated with a pair of said burners and said circuit controlling the specific pair of said burners in response to activation of said combined burner indicia and the power setting for said pair of burners set in response to activation of one of said plurality of power lever switches.

3. The control according to claim 1, including said second set of indicia including a separate warming display and a low level warming power level switch associated therewith.

4. The control according to claim 1, including a sensor probe extending above said cooktop.

5. The control according to claim 4, including a pot sensor display activated by said sensor probe sensing a pot.

6. The control according to claim 5, including a separate warming display and a low level warming power level switch associated therewith.

7. The control according to claim 6, including said pot sensor located substantially centrally and separated from said inner ring and said warming display located substantially adjacent an open end of said inner ring.

8. The control according to claim 1, including a separate warming display and a low level warming power level switch associated therewith.

9. A cooktop control for a cooktop including a glass ceramic panel and a plurality of burners forming a pattern under said panel, said control, comprising:

a first set of burner indicia visible on said cooktop panel in a first control area separated from said burners, each one of said indicia separately associated with one of said burners, said indicia formed in a pattern matching said burner pattern, each one of said separate burner indicia each including a display and a switch associated therewith;

a single second set of indicia visible on said cooktop panel in a second control area separated both from said burners and said first control area, said second set of indicia including a display and a first plurality of power level switches associated therewith, said second set of indicia controlling the power level of each of said burner indicia, said single second set of indicia formed in a substantially circular arc or ring, said second set of indicia including a separate warming display and a low level warming power level switch associated therewith;

an inner indicia ring including a third set of indicia, said inner indicia ring located adjacent said ring of said second set of indicia, said inner ring of indicia including a display and a second plurality of power level switches associated therewith;

a circuit controlling the specific one of said burners in response to activation of said associated first indicia and the power setting for said specific associated burner set in response to activation of one of said plurality of power lever switches; and said first set of indicia including a combined burner operating indicia including a display and a switch associated therewith associated with a pair of said burners and said circuit controlling the specific pair of said burners in response to activation of said combined burner indicia and the power setting for said pair of burners set in response to activation of one of said plurality of power lever switches.

10. The control according to claim 9, including a sensor probe extending above said cooktop panel.

11. The control according to claim 10, including a pot sensor display activated by said sensor probe sensing a pot.

12. The control according to claim 11, including said pot sensor located substantially centrally and separated from said inner ring and said warming display located substantially adjacent an open end of said inner ring.

* * * * *